United States Patent [19]

Dupressoir

[11] 4,388,624

[45] Jun. 14, 1983

[54] RADAR ANTENNA INCORPORATING ELEMENTS RADIATING A PSEUDO-OMNIDIRECTIONAL PATTERN

[75] Inventor: Albert Dupressoir, Paris, France

[73] Assignee: "Thomson-CSF", Paris, France

[21] Appl. No.: 199,992

[22] Filed: Oct. 23, 1980

[30] Foreign Application Priority Data

Oct. 26, 1979 [FR] France ..... 79 26609

[51] Int. Cl.[3] ..... H01Q 5/00; H01Q 25/00

[52] U.S. Cl. ..... 343/727; 343/853

[58] Field of Search ..... 343/727, 729, 730, 840, 343/853

[56] References Cited

U.S. PATENT DOCUMENTS 2,846,678 8/1958 Best ..... 343/727

3,445,850 5/1969 Stegen ..... 343/727

FOREIGN PATENT DOCUMENTS 2315181 1/1977 France ..... 343/727

*Primary Examiner*—Eli Lieberman

*Attorney, Agent, or Firm*—Oblon, Fisher, Spivak, McClelland & Maier

[57] ABSTRACT

Radar antenna incorporating elements radiating a pseudo-omnidirectional pattern having a crevasse in the direction of the major lobe of the directional pattern radiated by the antenna and being constituted by one or more groups of dipole pairs placed above and in the vicinity of the antenna reflector and symmetrically with respect to its plane of symmetry.

6 Claims, 4 Drawing Figures

RADAR ANTENNA INCORPORATING ELEMENTS RADIATING A PSEUDO-OMNIDIRECTIONAL PATTERN

BACKGROUND OF THE INVENTION

The present invention relates to a radar antenna incorporating elements radiating a pseudo-omnidirectional pattern.

The invention is applicable on the one hand to an antenna for primary radar ensuring the side lobe blanking (S.L.B.) function for the directional pattern, which consists of covering these side lobes of the directional radiation pattern emitted by the primary source of the radar with a pseudo-omnidirectional radiation pattern, whose level is higher than that of the side lobes to be covered. The invention is also applicable to a common antenna for primary and secondary radars having an interrogation system of the IFF type and which also ensures the side lobe suppression (S.L.S.) function of the directional pattern.

An antenna for filling the primary radar function has a reflector supplied in such a way that it radiates energy for the purpose of detecting a target. When, for example, this target has a sufficiently high interference level to cover the side lobes of the directional pattern radiated by the antenna particular interest is attached to the answer of this target in the axis of the major lobe of the directional pattern by attempting to mask the interference of the target by a pseudo-omnidirectional pattern. To this end a source is placed above the antenna reflector, for example a horn, which radiates such a pattern. However, this type of source has the disadvantage of being heavy and complicated.

The term common antenna for primary and secondary radars is understood to mean a single reflector supplied so as to ensure the direction function of a primary radar and which is also able to emit an interrogation signal from said target and to receive the answer from its on-board transponder, i.e. what is called the secondary radar function.

The beam carrying the interrogation is directional, interrogating in the direction where the aircraft has been detected. However, it has been found that the responder of the interrogated aircraft could be triggered by the side lobes of the interrogation pattern, whose level may be relatively high compared with that of the major lobe. Thus, errors can occur and their consequences may be dangerous. To obviate this disadvantage this single antenna is supplemented by so-called control means incorporating radiating elements acting at the reception of the interrogation by the interrogated responder and at the reception of the answer from the latter by the receiver in question. They radiate in accordance with a quasi-omnidirectional pattern, whose level is such that it covers the side lobes of the pattern radiated by the main antenna.

By comparison in the associated circuits of the amplitude of the pulses received from the responder and the control pulses this arrangement makes it possible to determine the pulses received in answer to the interrogation by the major lobe.

The control means for realizing this control diagram must be such that the gain of the associated control channels is higher than that of the interrogation and reception channels in the angular areas comprising the side lobes of the directional interrogation pattern, but much lower in the direction of their major lobe.

In the existing constructions the control means are either physically independent of the main antenna constituted by an omnidirectional antenna placed alongside the main antenna, or are dependent, the control function being fulfilled by the secondary radar antenna supplied for a given time so as to give a radiation pattern of the difference type, whilst the pattern by which the interrogation takes place is a sum pattern.

However, and despite the precautions which have been taken, it would appear that the radiation pattern of the control means does not completely fulfill its function, either because it is not totally omnidirectional, or because certain high level side lobes of the main directional pattern are not covered and also because in certain cases the major lobe, whose level is a little low, is liable to be smothered by the omnidirectional pattern. Moreover, the control patterns can be disturbed by certain external installations such as, for example, the radomes under which the antennas are placed.

BRIEF SUMMARY OF THE INVENTION

The object of the invention is to obviate these disadvantages and provide an antenna having elements which radiate a pseudo-omnidirectional pattern.

The present invention therefore relates to a radar antenna comprising a reflector illuminated by one or more transmission-reception sources, at least one of them radiating a directional pattern and having a system of elements radiating a pattern of the pseudo-omnidirectional type with a crevasse in the direction of the major lobe of the directional pattern radiated by one of the sources, wherein the system of radiating elements is constituted by one or more groups of two dipoles placed above and in the vicinity of the reflector, symmetrically with respect to the plane of symmetry thereof, the distance between two consecutive dipoles being between 0.5 and 0.8 times the wavelength at the centre frequency of the operating band, in such a way that they radiate towards the front thereof and independently thereof produce a pseudo-omnidirectional pattern.

The invention can use an antenna for a primary radar which ensures the side lobe blanking function. It can also use a common antenna for primary and secondary radars which also fulfills the side lobe suppression function.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
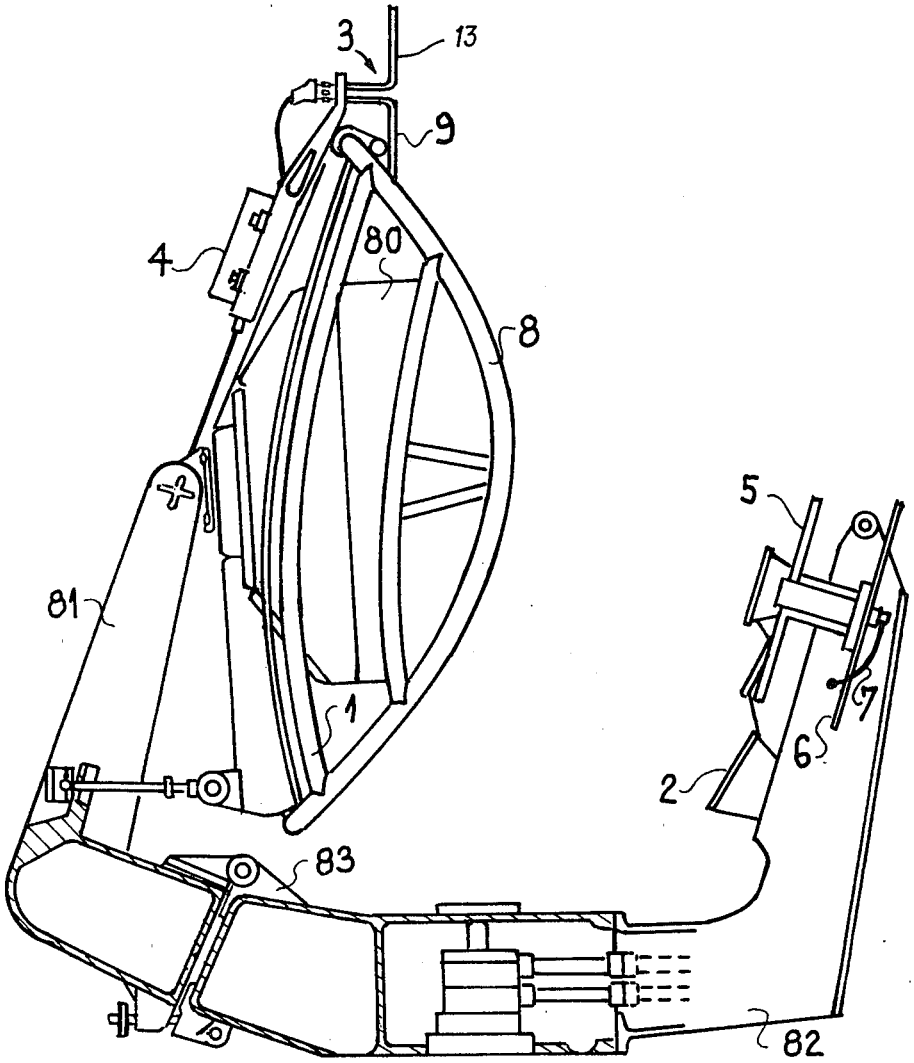
FIG. 1 a diagrammatic view of an antenna in the plane of symmetry $\pi$ of the reflector, having elements radiating a pseudo-omnidirectional diagram according to the invention.

Thus, the invention relates to a radar antenna having elements radiating a pseudo-omnidirectional pattern. FIG. 1 shows in diagrammatic manner an antenna comprising a reflector 1 having a random configuration, illuminated by a primary source 2 placed in front of it and radiating a directional pattern. The elements radiating a pseudo-omnidirectional control pattern are constituted by a group of two detachable dipoles 3 having upper legs 13 and lower legs 9 as shown in FIGS. 1 and 2 of the full wave or half-wave type arranged in juxtaposed manner just above the antenna reflector 1 in the median plane thereof.

The position of the dipoles is such that they free the reflectors both for correctly radiating without being disturbed by the same and for not forming a shadow relative to the radiation from the primary source 2. However, it is accepted that they can occult reflector 1 by the lower legs 9, as shown in FIG. 1. The distance between the two dipoles 3 is between 0.5 and 0.8 times the wavelength of the centre frequency of the operating band so as to obtain the desired pseudo-omnidirectional pattern, i.e. covering the side lobes of the directional pattern, but having a crevasse centred on the direction of the major lobe of the same pattern. For reasons of symmetry, as the crevasse of the pseudo-omnidirectional pattern must coincide with the direction of the major lobe of the associated directional pattern the two dipoles are arranged symmetrically with respect to the plane of symmetry $\pi$ of the reflector. They are supplied in phase opposition by means of two power dividers 4 which are also detachable and radiate directly without a reflector to cover the side lobes of the directional pattern with a 360° aperture. Thus, their pseudo-omnidirectional radiation pattern has a crevasse symmetrical to the main crevasse in the direction of the major lobe of the directional pattern.

Figure 2:
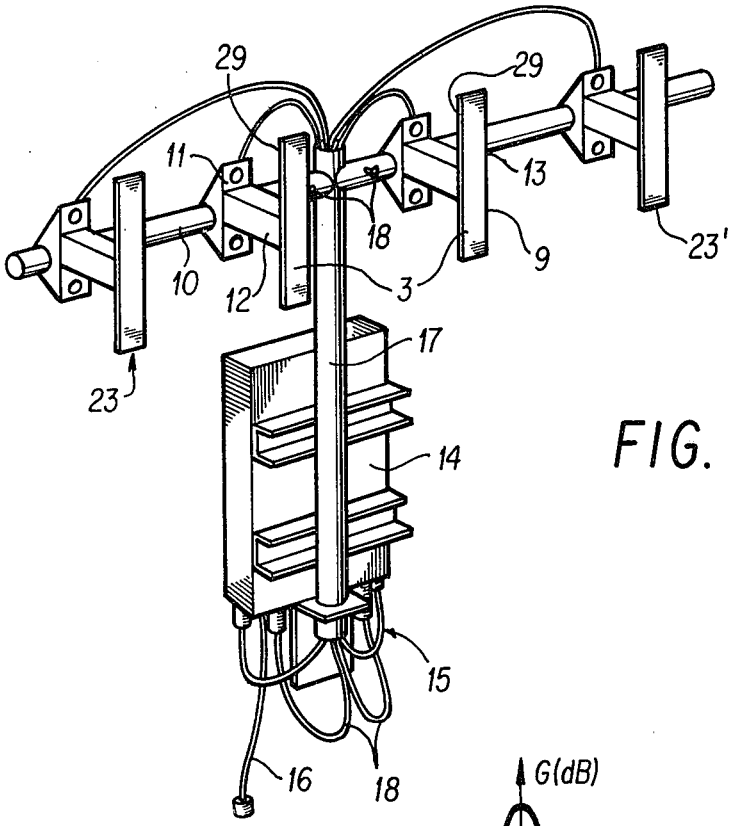
FIG. 2 a diagrammatic representation of a non-limitative embodiment of elements radiating a pseudo-omnidirectional diagram according to the invention.

The side lobe suppression function can also be ensured by several groups of dipole pairs distributed symmetrically on either side of the plane of symmetry $\pi$ of the reflector 1 in accordance with a linear array as illustrated in FIG. 2 which shows, for example, an additional pair of dipoles 23 and 23'. The same comments as made hereinbefore with respect to their position remain valid and the distance between the two consecutive dipoles is between 0.5 and 0.8 times the wavelength at the centre frequency of the operating band.

An antenna formed in this way can be used for a primary radar having a side lobe blanking function ensured by dipoles 3, which radiate a pseudo-omnidirectional pattern having a crevasse centred on the major lobe of the directional pattern of the primary source 2.

In the case of a common antenna for primary and secondary radars, besides the primary source 2 illuminating the reflector 1, there is, alongside it, a source 5 constituted for example by two dipoles of the full or half-wave type provided with appropriate reflectors. These dipoles are energized in phase by means of a not shown, conventional, power divider and two coaxial connecting cables 7. These dipoles radiate the directional pattern of the reception interrogation channel of the secondary radar. The dipoles 3 radiating the pseudo-omnidirectional pattern of the control channel whose crevasse coincides with the major lobe of the directional pattern of the interrogation channel ensure the side lobe suppression function of the secondary radar, to the extent that their pattern covers all the interrogation pattern, except in the direction of the major lobe.

FIG. 1 shows a radome 8 and stabilization devices 80 for the antenna reflector 1. Reflector 1 is located on the detachable part 81 of a frame 82 having a fixing system 83. This makes it possible to fold back the antenna, by tilting reflector 1 towards frame 82. The fact that dipoles 3 and dividers 4 are detachable provides the advantage that they can be retracted or folded back when it is desired to fold back the antenna, e.g. in the case of transportation.

FIG. 2 shows an example of an element radiating a pseudo-omnidirectional pattern used in an antenna according to the invention. This element comprises two conventional dipoles 3, of the half-wave or full wave type, which are juxtaposed in parallel on a fixing rod 10. They are constituted by a coaxial base 11, an open coaxial line 12 serving as an adapter and symmetrizer and two radiating legs 9, 13 for each of the dipoles 3 as detailed in FIGS. 1 and 4, whose length is generally equal to quarter or half the operating wavelength of the system. These two dipoles are connected to a conventional power divider 14 by coaxial cables 15, whilst another coaxial connecting cable 16 connects the power divider and the antenna reflector. Power divider 14 is fixed to a rod 17 forming a T with the rod 10. As previously indicated, the dipoles 23 and 23' are mounted on the rod 10. It is noted that the curvature of the rod 10 must conform to the antenna reflector structure to ensure that each pair of dipoles are distributed symmetrically with respect to the plane of symmetry of the reflector. Three fixing means 18, such as screws, can be provided for fixing the radiating element to the antenna reflector. The fact that these radiating elements are constructed independently of the reflector and have means for fixing to the latter makes it possible to set them down or retract them during movements of the antenna, which then has reduced overall dimensions. The FIG. 2 further shows a weather protective plastic covering 29 for each dipole.

The description of the dipoles given hereinbefore is not intended to be in any way limitative and it is possible to envisage the use of dipoles obtained by the photogravure of a copper sheet on a dielectric wafer, using much the same procedure as that employed for printed circuits.

Figure 3:
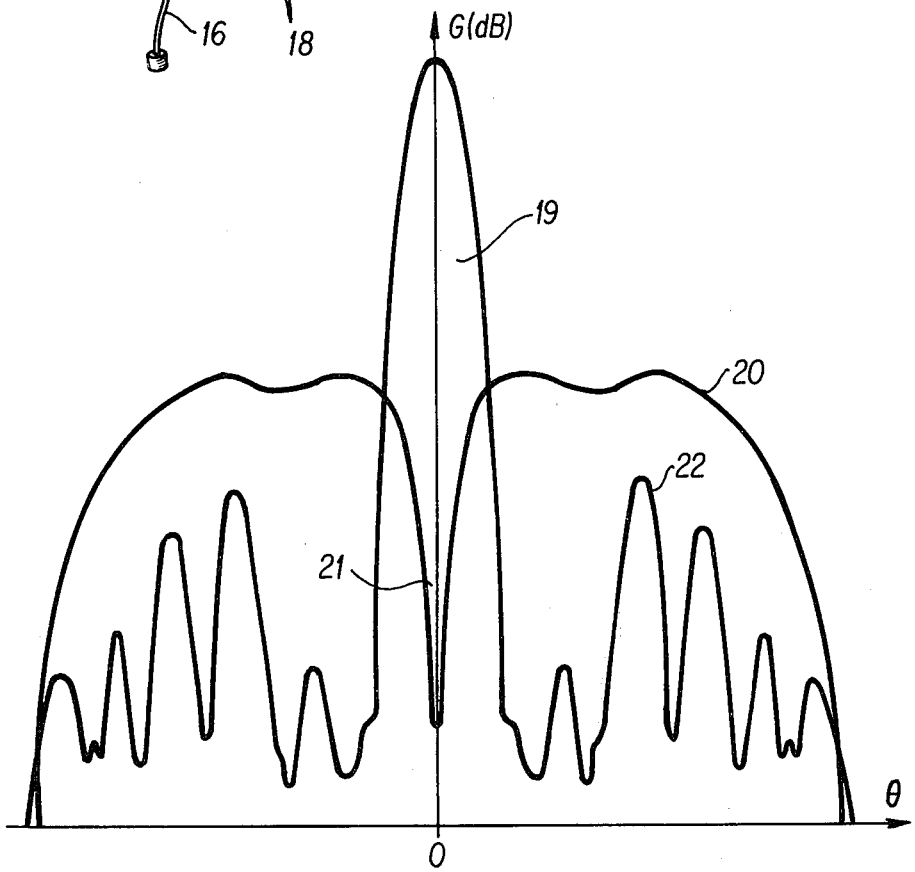
FIG. 3 the antenna radiation diagrams incorporating radiating elements according to the invention in the bearing plane.

FIG. 3 shows the pseudo-omnidirectional radiation pattern emitted by the elements associated with an antenna according to the invention, as well as a typical directional pattern. Both of these patterns are located in the bearing plane designated by the abscissa axis $\theta$ (bearing angle) and ordinate axis G (gain in dB). The directional pattern 19 is that emitted by an antenna for primary radar or that emitted by the interrogation-reception channel of a common antenna for primary and secondary radar. The pseudo-omnidirectional pattern 20 radiated by the elements according to the invention covers the side lobes 22 of the directional pattern, except in the direction of the major lobe of the latter where it has a crevasse 21. As has been stated hereinbefore there is also a crevasse, but with a much smaller amplitude, in the axis of the major lobe, but in the opposite direction due to the power supply for the dipoles.

The shape of the pseudo-omnidirectional pattern with its level drop in the bearings at 180° from the direction of the major lobe of the directional pattern, reveals an angular zone in which the covering of the directional pattern is not apparently ensured. However, this does not cause serious disadvantages from the operational standpoint in that these overlaps relate to very limited levels (below the isotropic level).

However, to ensure satisfactory operation an IFF antenna according to the invention must have a good covering or overlap level and processing arc widths which are compatible with the large angular aperture generally required in elevation. This makes it necessary to have a high omnidirectionality of the pattern, outside the axial region.

Figure 4:
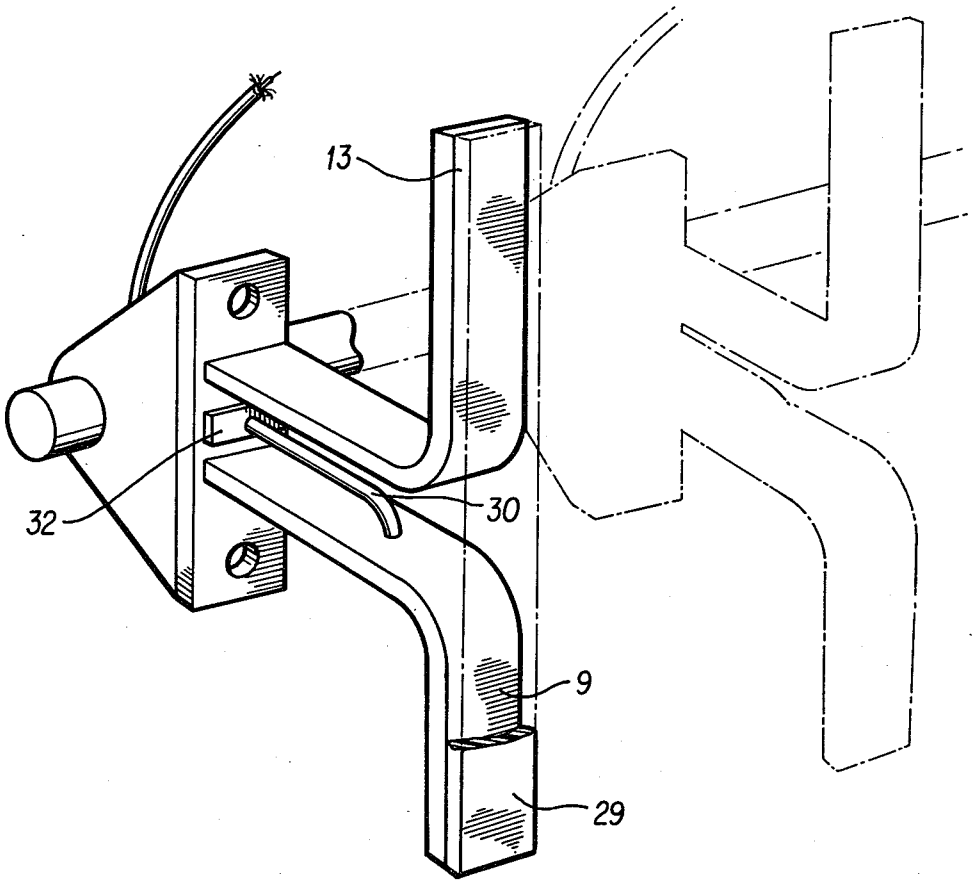
FIG. 4 an internal view of a conventional dipole antenna used in FIGS. 1 and 2.

The FIG. 4 details a conventional dipole used as any of the dipoles 3 or 23 and 23' in FIGS. 1 and 2. Power is supplied to the leg 9 through lead 30 from a coaxial connector 32 with leg 13 being the ground or common feed from a coaxial cable such as 15 in FIG. 2.

A radar antenna has been described hereinbefore having elements radiating a pseudo-omnidirectional pattern.

What is claimed is:

1. A radar antenna comprising:

a reflector illuminated by at least one transmission-reception source, one of said at least one transmission-reception source radiating a directional pattern; and a system of elements radiating a pattern of the pseudo-omnidirectional type with a crevasse in the direction of the major lobe of the directional pattern radiated by one of said at least one transmission-reception source, wherein the system of radiating elements is constituted by at least one group of two dipoles placed above and in the vicinity of the reflector, symmetrically with respect to the plane of symmetry thereof, the distance between two consecutive dipoles being between 0.5 and 0.8 times the wavelength at the center frequency of the operating band, in such a way that they radiate towards the front thereof and independently thereof a pseudo-omnidirectional pattern.

2. An antenna according to claim 1, wherein the dipoles are of the half-wave or full wave types adapted to the center frequency of the operating band of the radar by an adapter-symmetrizer and supplied in phase opposition by means of a power divider.

3. An antenna according to claims 1 or 2, wherein said dipoles are situated with respect to said reflector in such a way that the horizontal plane at the top of the reflector intersects the lower legs of each of the dipoles.

4. An antenna according to claim 1, wherein the dipoles and the power divider are mounted on two retractable rods forming a T.

5. An antenna according to claim 1, wherein said antenna is a common antenna for primary and secondary radars wherein said reflector comprises a single reflector and wherein said at least one transmission-reception source comprises a primary transmission-reception source and a second transmission-reception source with said secondary transmission-reception source located in the vicinity of said primary source and wherein said single reflector is illuminated by said primary transmission-reception source and by said secondary transmission-reception source with said secondary source radiating the directional pattern of the interrogation channel and incorporating at least one multiple of two dipoles for radiating a control pattern.

6. An antenna according to claim 1, wherein said at least one group of two dipoles is a plurality of groups.

* * * * *